US010381773B2

(12) United States Patent
Hashimoto

(10) Patent No.: US 10,381,773 B2
(45) Date of Patent: Aug. 13, 2019

(54) CONNECTOR

(71) Applicant: Sumitomo Wiring Systems, Ltd., Yokkaichi, Mie (JP)

(72) Inventor: Tsutomu Hashimoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/765,302

(22) PCT Filed: Sep. 12, 2016

(86) PCT No.: PCT/JP2016/076771

§ 371 (c)(1),
(2) Date: Apr. 2, 2018

(87) PCT Pub. No.: WO2017/056936

PCT Pub. Date: Apr. 6, 2017

(65) Prior Publication Data

US 2018/0309229 A1 Oct. 25, 2018

(30) Foreign Application Priority Data

Oct. 1, 2015 (JP) ..... 2015-195642

(51) Int. Cl.
*H01R 13/40* (2006.01)
*H01R 13/52* (2006.01)
(Continued)

(52) U.S. Cl.
CPC ..... *H01R 13/5216* (2013.01); *H01R 43/005* (2013.01); *H01R 13/405* (2013.01); *H01R 13/521* (2013.01)

(58) Field of Classification Search
CPC ..... H01R 13/405; H01R 13/521; H01R 13/5216; H01R 43/005
(Continued)

(56) References Cited

U.S. PATENT DOCUMENTS 4,445,748 A * 5/1984 Evans ..... H01R 4/2429 439/271
5,588,885 A * 12/1996 Gotz ..... H01R 4/028 228/39
(Continued)

FOREIGN PATENT DOCUMENTS

| | | |
|---|---|---|
| JP | 2002-025683 | 1/2002 |
| JP | 2010-118231 | 5/2010 |
| JP | 2013-157256 | 8/2013 |

OTHER PUBLICATIONS

International Search Report dated Nov. 22, 2016.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A connector includes a connector housing (30) having a separation wall (33), through which a plurality of terminal fittings (20) penetrate, and a receptacle (51) configured to surround a group of the terminal fittings (20) projecting from the separation wall (33), a filling recess (55) configured to surround the terminal fittings (20) in the receptacle (51) and fill a potting agent (80) inside, and auxiliary reservoir portions (57) for the potting agent (80) formed to have a recessed shape on an inner peripheral surface side of the receptacle (51) while communicating with each filling recess (55).

5 Claims, 12 Drawing Sheets

(51) Int. Cl.
*H01R 43/00* (2006.01)
*H01R 13/405* (2006.01)

(58) Field of Classification Search
USPC ..... 439/587
See application file for complete search history.

(56) References Cited

U.S. PATENT DOCUMENTS 5,637,007 A * 6/1997 Suzuki ..... H01R 13/5216 439/276
6,010,348 A * 1/2000 Alden ..... H01R 13/506 439/274
6,126,483 A * 10/2000 Kirma ..... B64D 15/12 219/541
6,149,456 A * 11/2000 Uchiyama ..... H01R 13/521 439/488
6,193,526 B1 2/2001 Sanuki
6,193,536 B1 * 2/2001 Sanuki ..... H01R 13/521 439/271
6,321,021 B1 * 11/2001 Cairns ..... G02B 6/4428 385/135
6,511,352 B2 * 1/2003 Suzuki ..... H01R 13/5219 439/271
6,616,480 B2 * 9/2003 Kameyama ..... H01R 13/521 439/271
6,641,417 B2 * 11/2003 Tanaka ..... H01R 13/5216 439/205
6,689,957 B2 * 2/2004 Onoda ..... H01R 13/5216 174/151
7,033,193 B2 * 4/2006 Higgins ..... H01R 13/5219 439/277
7,445,481 B2 * 11/2008 Nagashima ..... H01R 13/521 439/276
7,581,988 B2 * 9/2009 Boehnlein ..... A61B 1/00052 439/585
8,137,136 B1 * 3/2012 Bench ..... H01R 13/5216 439/604
8,337,227 B2 * 12/2012 Arai ..... H01B 7/285 439/271
8,348,689 B2 * 1/2013 Shibata ..... H01R 13/5202 174/153 G
8,550,844 B2 * 10/2013 Fujisaki ..... H01R 13/521 439/587
8,814,606 B2 * 8/2014 Endo ..... H01R 13/405 439/736
8,905,783 B2 * 12/2014 Umemoto ..... H01R 33/965 439/274
9,017,088 B2 * 4/2015 Endo ..... H01R 9/00 439/276
9,379,480 B2 * 6/2016 Sato ..... H01R 13/5202
9,666,985 B2 * 5/2017 Bernardi ..... H01R 13/631
9,674,410 B2 * 6/2017 Uchiyama ..... H04N 5/2252
10,039,189 B2 * 7/2018 Andoh ..... H01R 13/4361

* cited by examiner

CONNECTOR

BACKGROUND

Field of the Invention

This specification relates to a connector.

Description of the Related Art

Japanese Unexamined Patent Publication No. 2013-157256 discloses a connector for a vehicle. This connector is mounted on a device case filled with oil, such as a differential gear case or a transmission case, and is used to connect a circuit arranged inside the device case and a control circuit or the like outside the case.

The connector has a housing and fitting recesses are provided on both sides across a separation wall of the housing. The connector is insert-molded with terminal fittings projecting into the fitting recesses through the separation wall. A potting agent is filled on a back side of one fitting recess so that oil does not leak through penetrating parts of the terminal fittings.

In the configuration of Japanese Unexamined Patent Publication No. 2013-157256, the potting agent is injected to the back side of the fitting recess while avoiding a part where the terminal fittings are projecting to prevent an injection inlet for the potting agent from contacting the terminal fittings. Thus, an injection position of the potting agent near a wall surface of the fitting recess of the connector housing. At such a position, the potting agent cannot spread toward the wall surface. Thus, when a high viscosity potting agent is injected, the potting agent may be raised on the wall surface side and leak out if an injection speed becomes faster than a spreading speed of the injected potting agent from an injection point.

SUMMARY

A connector disclosed in this specification includes a connector housing having a separation wall, and terminal fittings penetrate through the separation wall. A receptacle surrounds a group of the terminal fittings projecting from the separation wall. A filling recess surrounds the terminal fittings in the receptacle to fill a potting agent inside. An auxiliary reservoir portion for the potting agent is recessed on an inner peripheral surface of the receptacle while communicating with each filling recess.

Accordingly, if the potting agent is injected near the auxiliary reservoir, the injected potting agent not only flows from an injection point to the filling recess, but also temporarily spreads to the auxiliary reservoir. Thus, even if an injection speed of the potting agent is high, a rising rate of a liquid surface at the injection point is smaller than in the absence of the auxiliary reservoir and the potting agent will not leak out from the receptacle.

A partition wall be provided in the filling recess and may be configured to surround the respective terminal fittings and may have a height to project from a liquid surface of the filled potting agent.

A part of the partition wall projecting from the potting agent exhibits a function of extending a creepage distance between the terminal fittings and improves insulation performance between the terminal fittings. The partition wall impedes the flow of the potting agent into the filling recess. However, the leak-out of the potting agent can be suppressed by the auxiliary reservoir.

The terminal fittings may constitute terminal fitting groups each of which is composed of the terminal fittings each other via the separation wall. An external matter preventing rib may be provided between the terminal fitting groups and may project farther than the terminal fittings to suppress the intrusion of external matter into the receptacle. The auxiliary reservoir may communicate with each area in the receptacle divided by the external matter preventing rib. According to this configuration, the potting agent can be poured equally into each filling recess by smoothing the flow of the injected potting agent.

The connector disclosed in this specification prevents having the potting agent raise on a wall surface side and leaking out.

DETAILED DESCRIPTION

<First Embodiment>

A first embodiment is described with reference to FIGS. 1 to 9.

A connector 10 in this embodiment is mounted into a mounting hole provided in a case of a transmission of a vehicle. The connector 10 is used to relay-connect a wiring harness disposed outside the transmission case and an electrical component disposed inside. Thus, the connector 10 has a function of preventing the entrance of water, external matter and the like into the inside of the transmission case from outside and a function of preventing the leakage of oil from the inside of the transmission case to outside.

Figure 1:
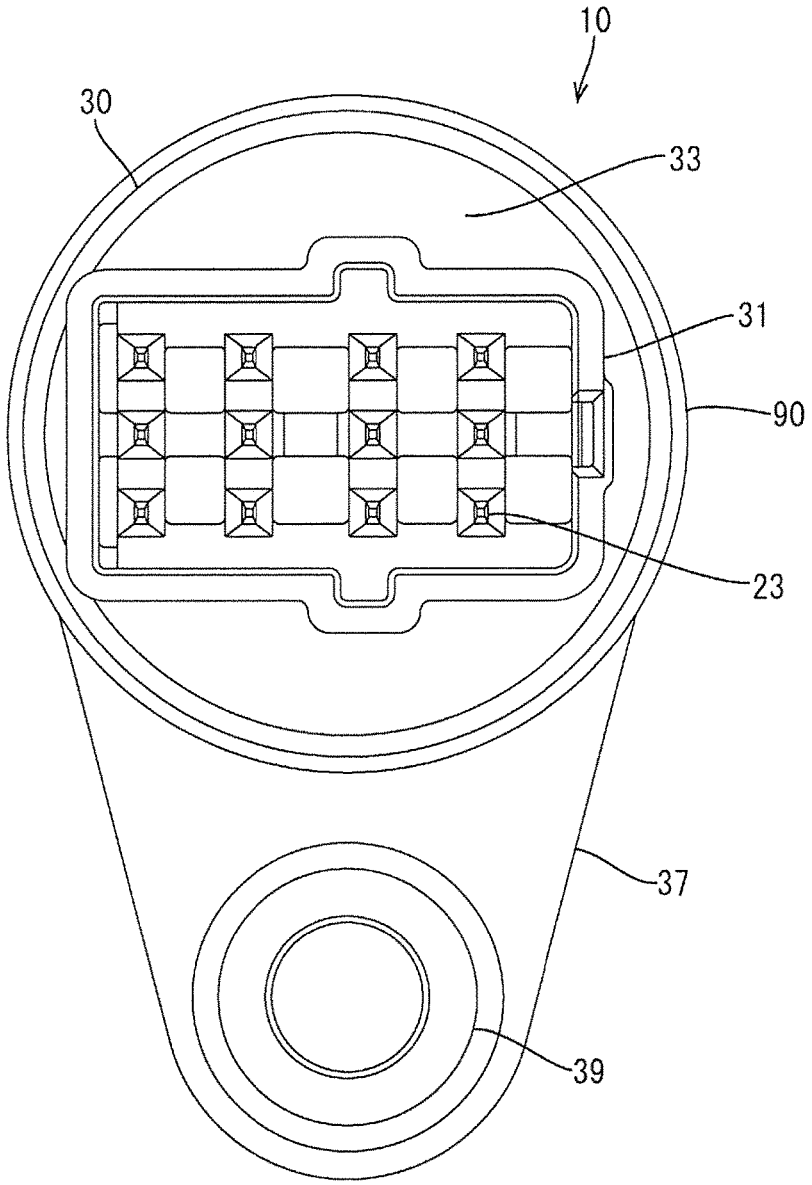
FIG. 1 is a front view of a connector in a first embodiment.
Figure 2:
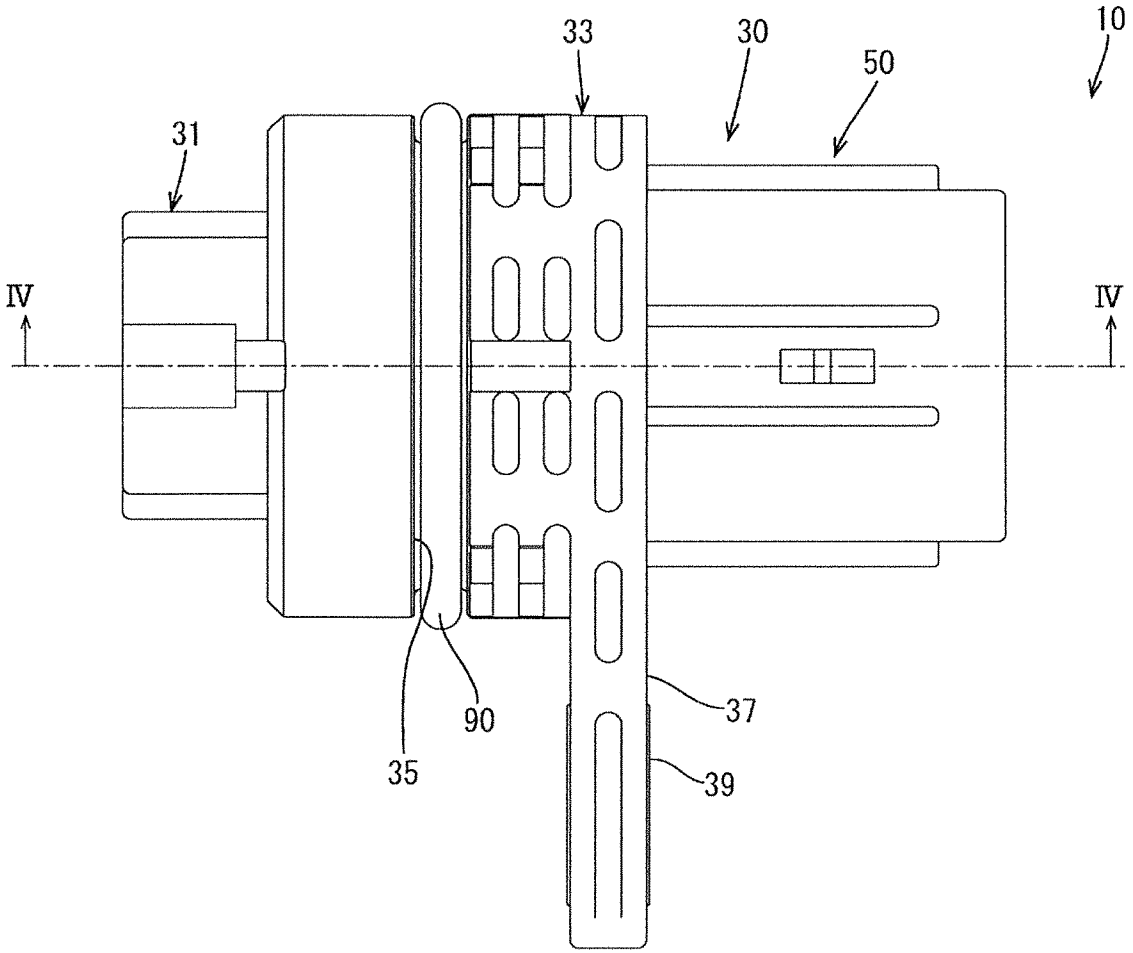
FIG. 2 is a side view of the connector.
Figure 3:
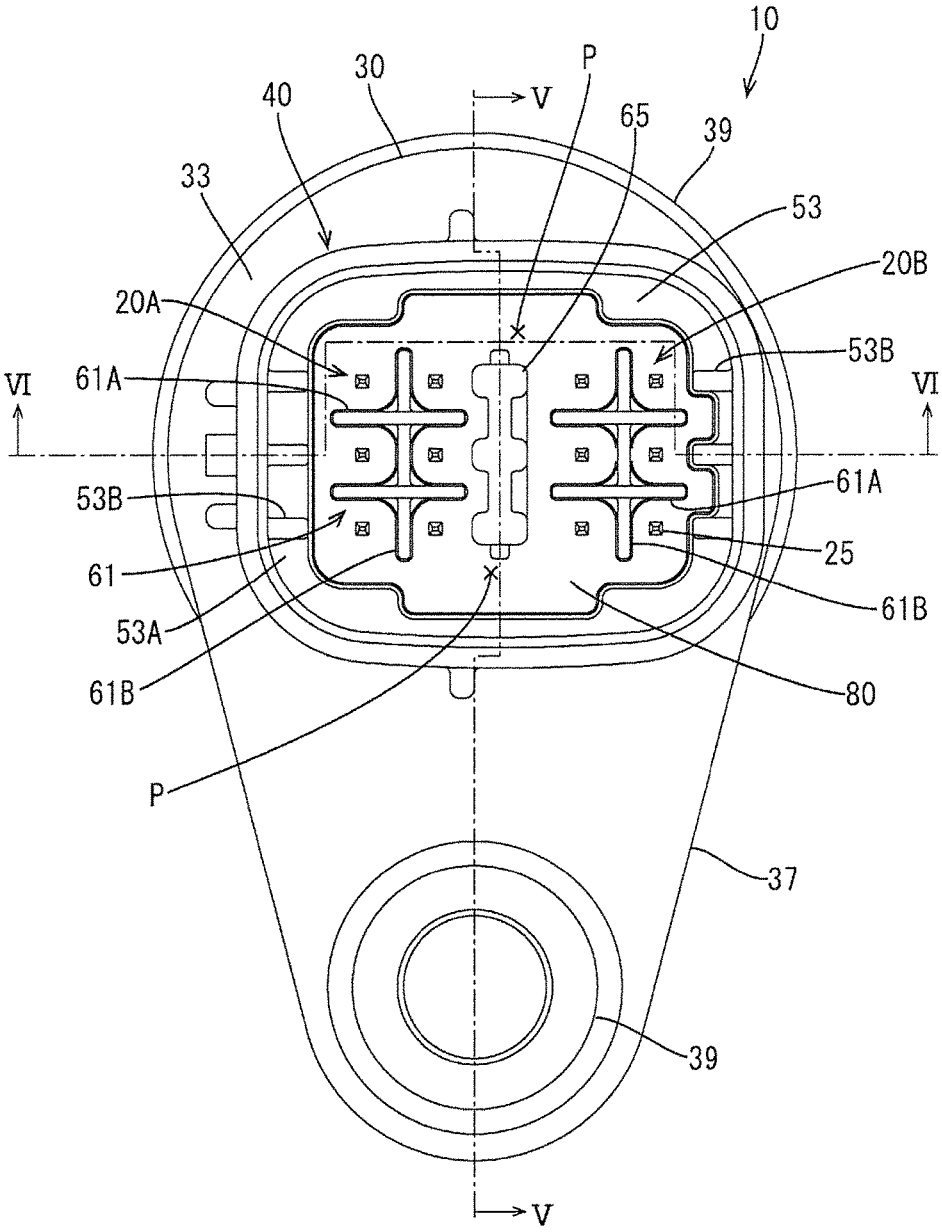
FIG. 3 is a back view of the connector.

As shown in FIGS. 1 to 3, the connector 10 includes terminal fittings 20, a connector housing 30 made of synthetic resin and a potting agent 80. The connector housing 30 includes an internal connecting portion 31 that connects to the electrical component in the transmission case, an external connecting portion 50 to be connected to the wiring harness and a separation wall 33 between the internal connecting portion 31 and the external connecting portion 50. A rubber ring mounting groove 35 is provided circumferentially on the outer periphery of the separation wall 33, and a rubber ring 90 is fit in the rubber ring mounting groove 35. Further, a mounting flange 37 projects out from the outer periphery of the separation wall 33 and is to be fastened to the transmission case by a bolt. A metal collar 39 is held on the mounting flange 37.

Figure 4:
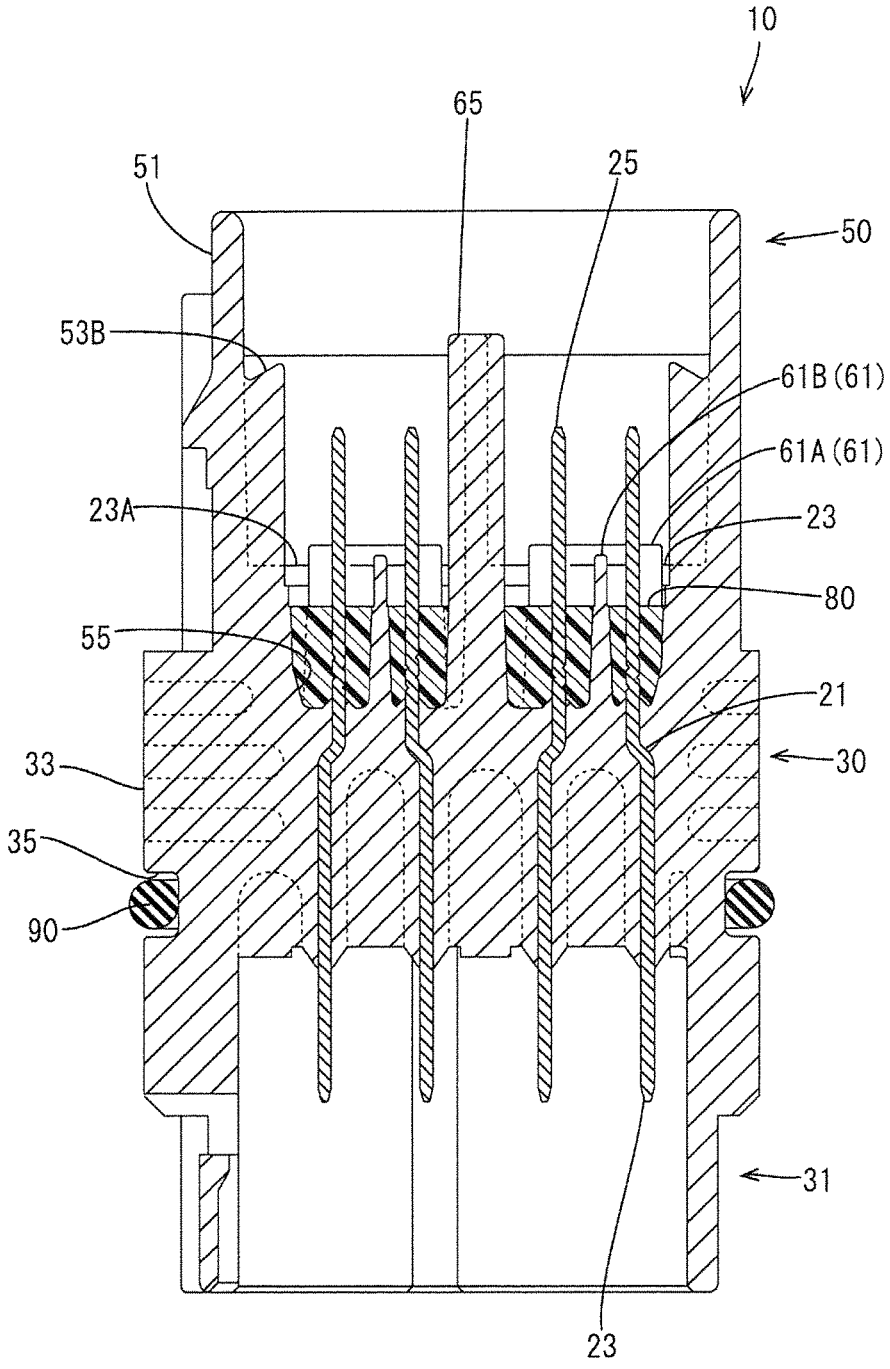
FIG. 4 is a section along IV-VI in FIG. 1.
Figure 5:
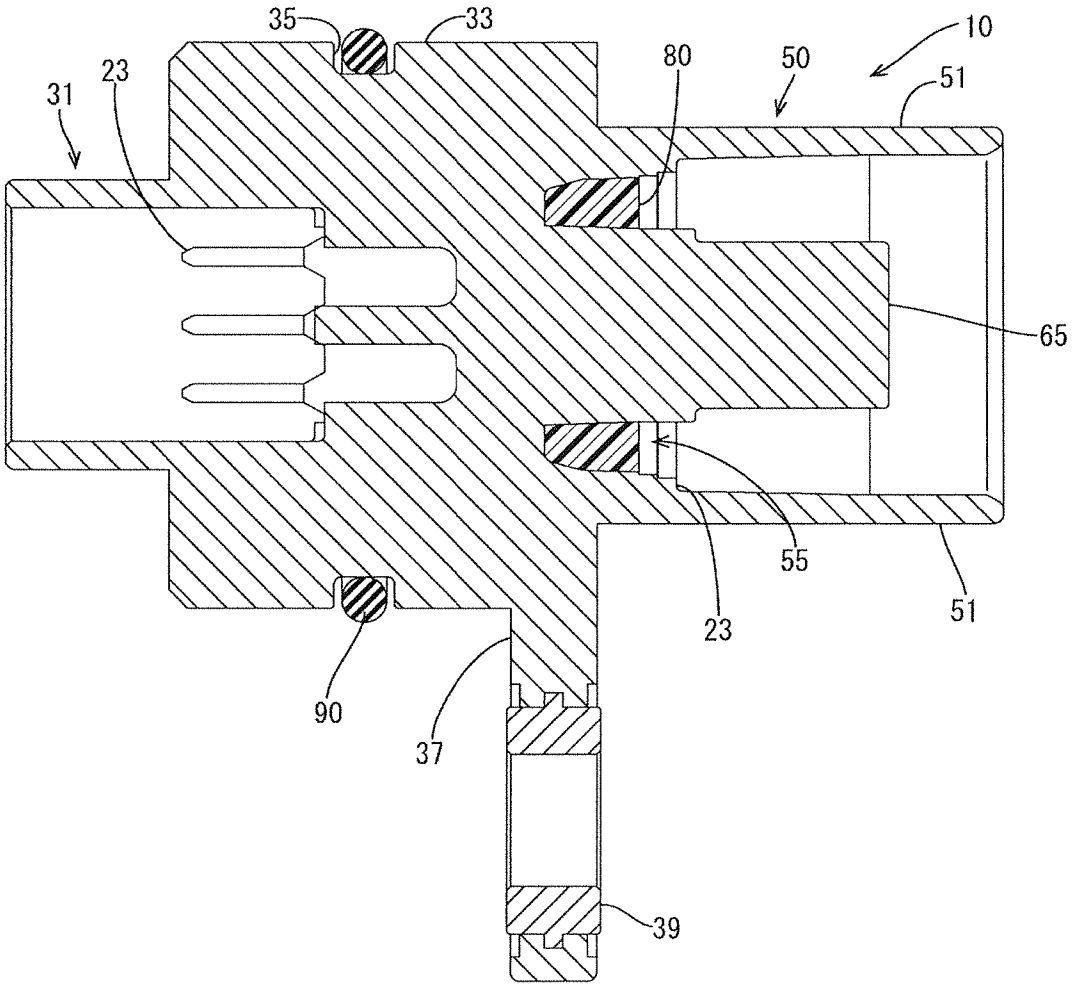
FIG. 5 is a section along V-V in FIG. 2.
Figure 6:
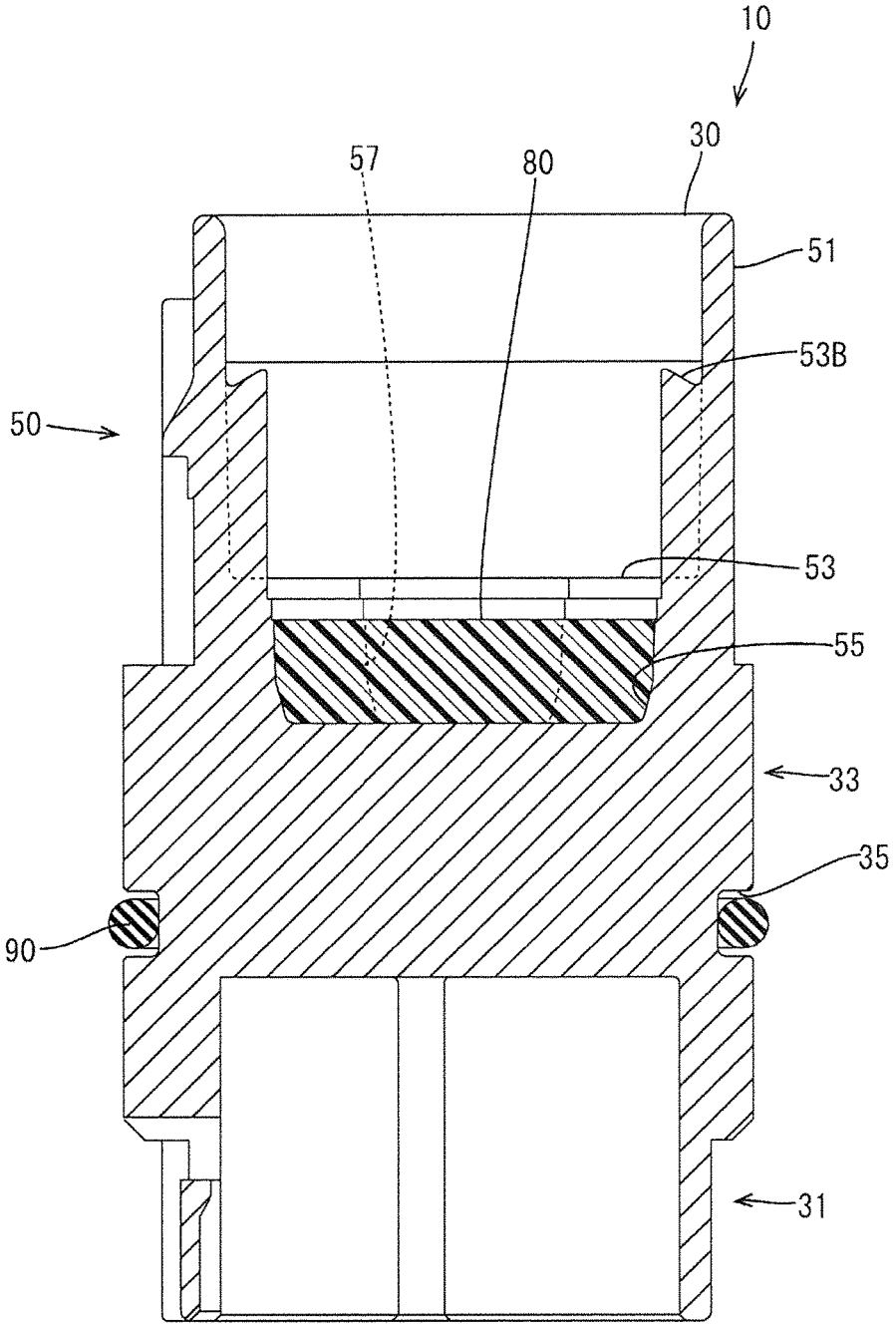
FIG. 6 is a section along VI-VI in FIG. 2.
Figure 7:
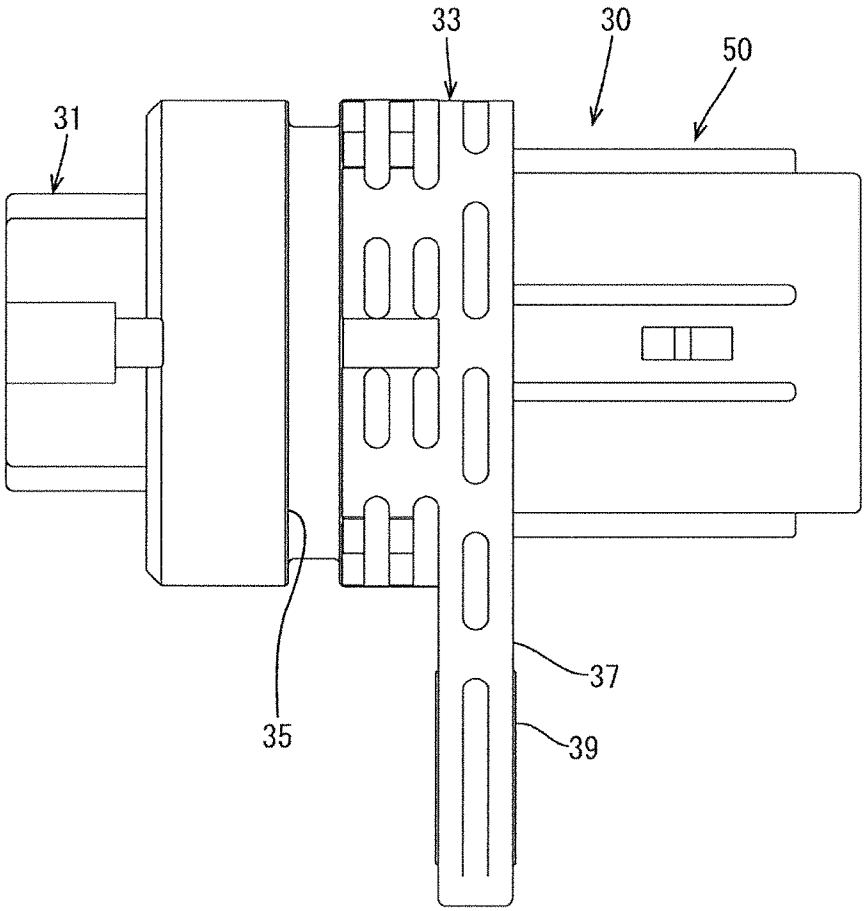
FIG. 7 is a side view of a connector housing.

As shown in FIGS. 4 and 5, terminal fittings 20 are held by the separation wall 33. Each terminal fitting 20 is a needle-like male terminal and is disposed through the separation wall 33. The terminal fitting 20 includes a crank-like bent portion 21 and the bent portion 21 is embedded in the separation wall 33 by insert molding. One end part 23 of the terminal fitting 20 projects into the internal connecting portion 31 from the separation wall 33, and another end part 25 projects into the external connecting portion 50 from the separation wall 33. As shown in FIG. 3, three terminal fittings 20 are arranged in a short-side direction in each of four columns spaced in a long-side direction. The terminal fittings 20 are divided into two terminal fitting groups 20A, 20B by a hand touch preventing rib 65 to be described later.

Figure 8:
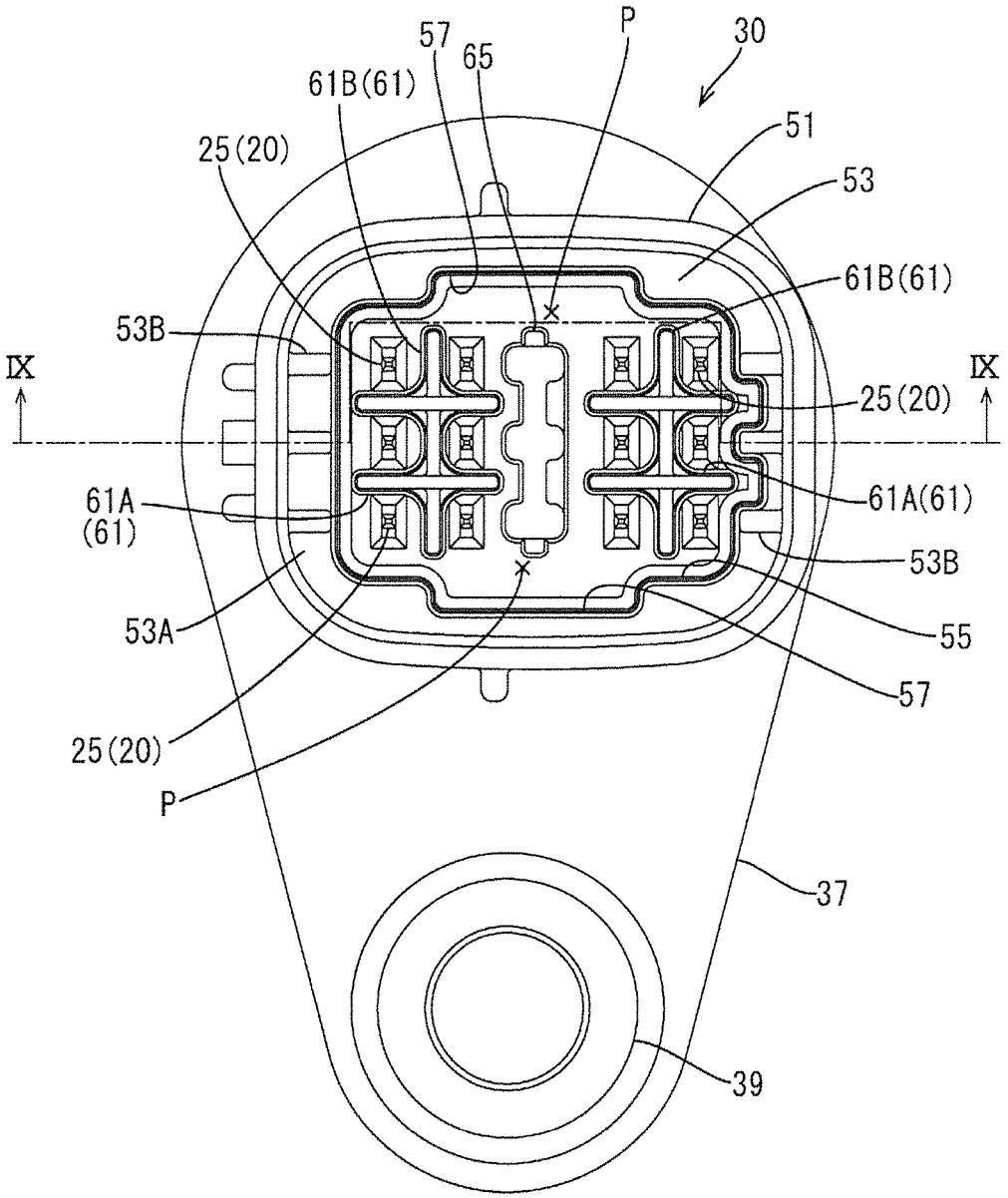
FIG. 8 is a section of the connector housing along V-V.

As shown in FIGS. 4 and 8, the external connecting portion 50 includes a receptacle 51, an inner wall 53 projecting in at a back side of the receptacle 51, a filling recess 55 surrounded by the inner wall 53, auxiliary reservoirs 57, partition walls 61 and the hand touch preventing rib 65 (an example of an "external matter preventing rib"). The receptacle 51 has a substantially rectangular inner peripheral shape to surround the terminal fittings 20 and surrounds the outer periphery of a fitting portion of a wiring harness side connector.

Figure 9:
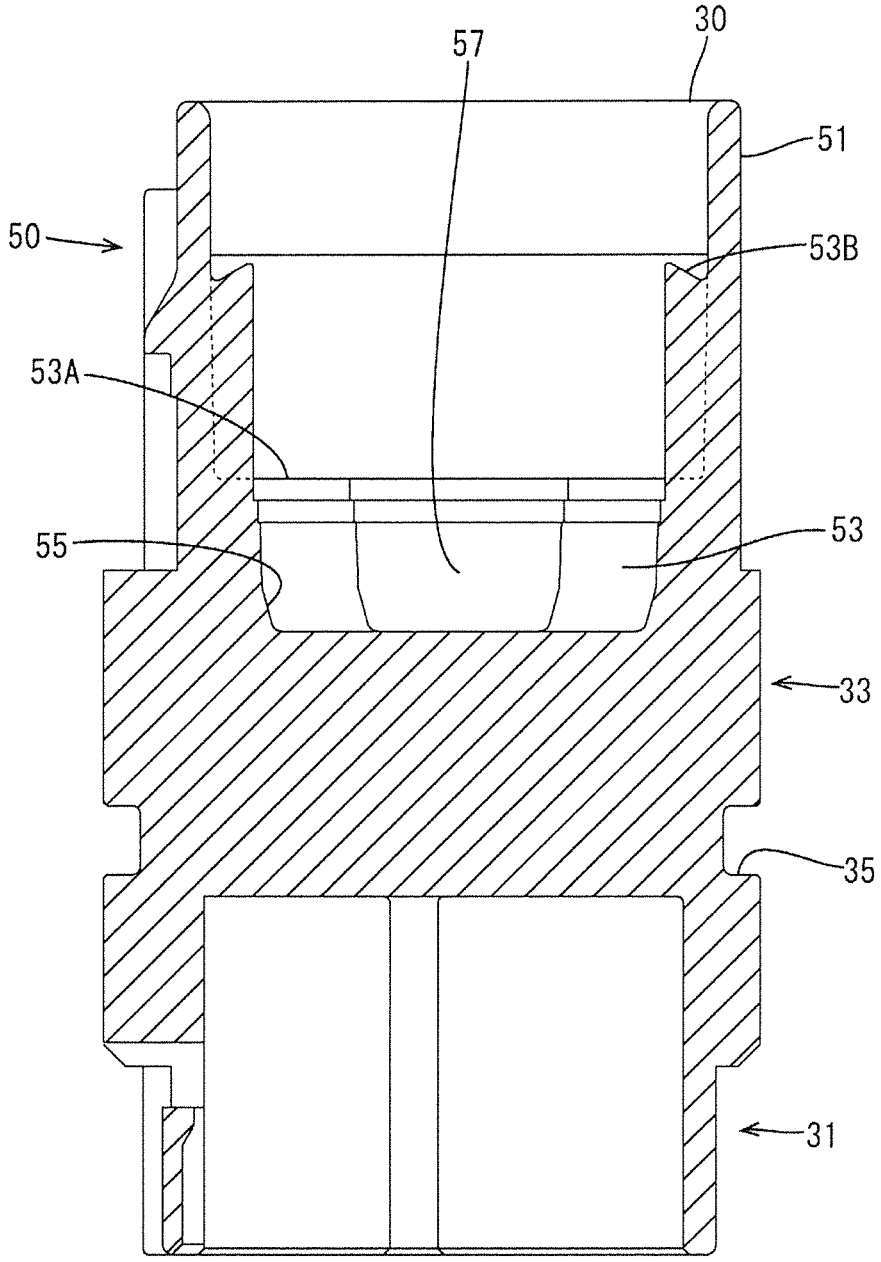
FIG. 9 is a section of the connector housing along VI-VI.

As shown in FIGS. 8 and 9, the inner wall 53 is formed by areas accounting for about one third of the back side (side of the separation wall 33) of the receptacle 51 projecting toward an inner peripheral side to be thickened, and has substantially the same inner peripheral shape as the receptacle 51. A surface on a back of the inner wall 53 serves as a connection surface 53A to the wiring harness side connector. Auxiliary ribs 53B for preventing hand touch project toward the back on lateral sides of the inner wall 53 in a width direction (long-side direction).

As shown in FIGS. 8 and 9, the filling recess 55 is substantially rectangular in a back view. In the filling recess 55, the other end parts 25 of the terminal fittings 20 projecting from the separation wall 33 at the back of the filling recess 55 are surrounded and the potting agent 80 (see FIG. 3) is filled inside. The auxiliary reservoirs 57 communicate with the filling recess 55. The auxiliary reservoirs 57 are provided substantially at central positions of the filling recess 55 in the long-side direction and on both sides of the filling recess 55 in the short-side direction. The auxiliary reservoirs 57 are formed by cutting off parts of the inner wall 53 toward the receptacle 51. The auxiliary reservoirs 57 are recessed on the inner peripheral surface of the receptacle 51. The back end surfaces of the auxiliary reservoirs 57 are located at the same positions as the back end surface of the filling recess 55.

As shown in FIG. 8, the partition walls 61 separate the other end parts 25 of adjacent terminal fittings 20 from each other. The partition wall 61 is provided for each of the two terminal fitting groups 20A, 20B. Each partition wall 61 includes two first partition walls 61A arranged parallel to each other and a second partition wall 61B arranged perpendicularly to the two first partition walls 61A to define a substantially lattice-shape. As shown in FIG. 4, each partition wall 61 is taller than a liquid surface height of the potting agent 80 while being shorter than a projecting height of the other end parts 25 of the terminal fittings 20.

Further, as shown in FIG. 8, the hand touch preventing rib 65 is provided in parallel to the second partition walls 61B. The hand touch preventing rib 65 is disposed substantially at a central position between two second partition walls 61B. As shown in FIG. 4, the hand touch preventing rib 65 is taller than the partition walls 61 and the projecting height of the other end parts of the terminal fittings 20. The filling recess 55 can be divided into two areas by the hand touch preventing rib 65.

As shown in FIGS. 4 and 8, the potting agent 80 is injected into the filling recess 55 from diagonal positions (injection points P) across the hand touch preventing rib 65. The potting agent 80 has a high viscosity and spreads in all directions at a slow speed while being slightly raised in a height direction, and spreads while flowing between each partition wall 61 and the inner wall 53 and between each partition wall 61 and the hand touch preventing rib 65. The terminal fitting groups 20A, 20B are separated by the hand touch preventing rib 65. Thus, the potting agent 80 can be poured equally into the filling recess 55. In this way, the potting agent 80 is injected into the filling recess 55 until the potting agent 80 is filled around a peripheral edge of each terminal fitting 20 and the liquid surface height thereof reaches a specified position. Note that the injection points P are not limited to the shown positions and may be other positions not in contact with the terminal fittings 20 and the like Further, the auxiliary reservoirs 57 are provided between the injection points P for the potting agent 80 and the inner wall 53. Thus, the injected potting agent 80 also spreads from the injection points P to the auxiliary reservoirs 57. That is, the potting agent 80 having spread from the injection points P toward the inner wall 53 spreads to the auxiliary reservoirs 57 rather than being raised in the height direction. Note that since the auxiliary reservoirs 57 are formed by partially cutting off the inner wall 53, the connection surface 53A can be ensured to have a sufficient area.

As shown in FIG. 4, when an injecting operation of the potting agent 80 is completed, the height of each partition wall 61 is higher than the liquid surface height of the potting agent 80. Thus, pairs of adjacent terminal fittings 20 are separated by each partition wall 61 projecting from the liquid surface of the potting agent 80 and sufficient creepage distances can be ensured between the pairs of terminal fittings 20. Further, the respective terminal fittings 20 can be protected by each partition wall 61 and the hand touch preventing rib 65.

As described above, in this embodiment, if the potting agent 80 is injected near the auxiliary reservoirs 57, the injected potting agent 80 not only flows from the injection points P to the filling recess 55, but also spreads to the auxiliary reservoirs 57. Thus, even if an injection speed of the potting agent 80 is high, a rising rate of the liquid surface at the injection points P is smaller than in the absence of the auxiliary reservoirs 57 and the leakage of the potting agent 80 from the receptacle 51 beyond the inner wall 53 can be suppressed.

Further, the partition walls 61 are provided in the filling recess 55 to surround the respective terminal fittings 20 and have heights to project from the liquid surface of the filled potting agent 80. Parts of the partition walls 61 projecting from the potting agent 80 exhibit a function of extending the creepage distances between the terminal fittings 20 and improve insulation performance between the terminal fittings 20. The partition walls 61 impede the flow of the potting agent 80 into the filling recess 55. However, the auxiliary reservoirs 57 prevent leakage of the potting agent 80.

The terminal fittings 20 constitute groups 20A, 20B composed of the terminal fittings 20 near each other via the partition wall 61. The hand touch preventing rib 65 for suppressing the intrusion of external matter (hand touch) into the receptacle 51 projects farther than the terminal fittings 20 between the terminal fitting groups 20A, 20B, and the auxiliary reservoirs 57 communicate with the respective areas in the receptacle 51 divided by the hand touch preventing rib 65. According to this configuration, the potting agent 80 can be poured equally into the filling recess 55 by smoothing the flow of the injected potting agent 80 while the intrusion of external matter (hand touch) into the receptacle 51 is suppressed by the hand touch preventing rib 65.

<Second Embodiment>

Figure 10:
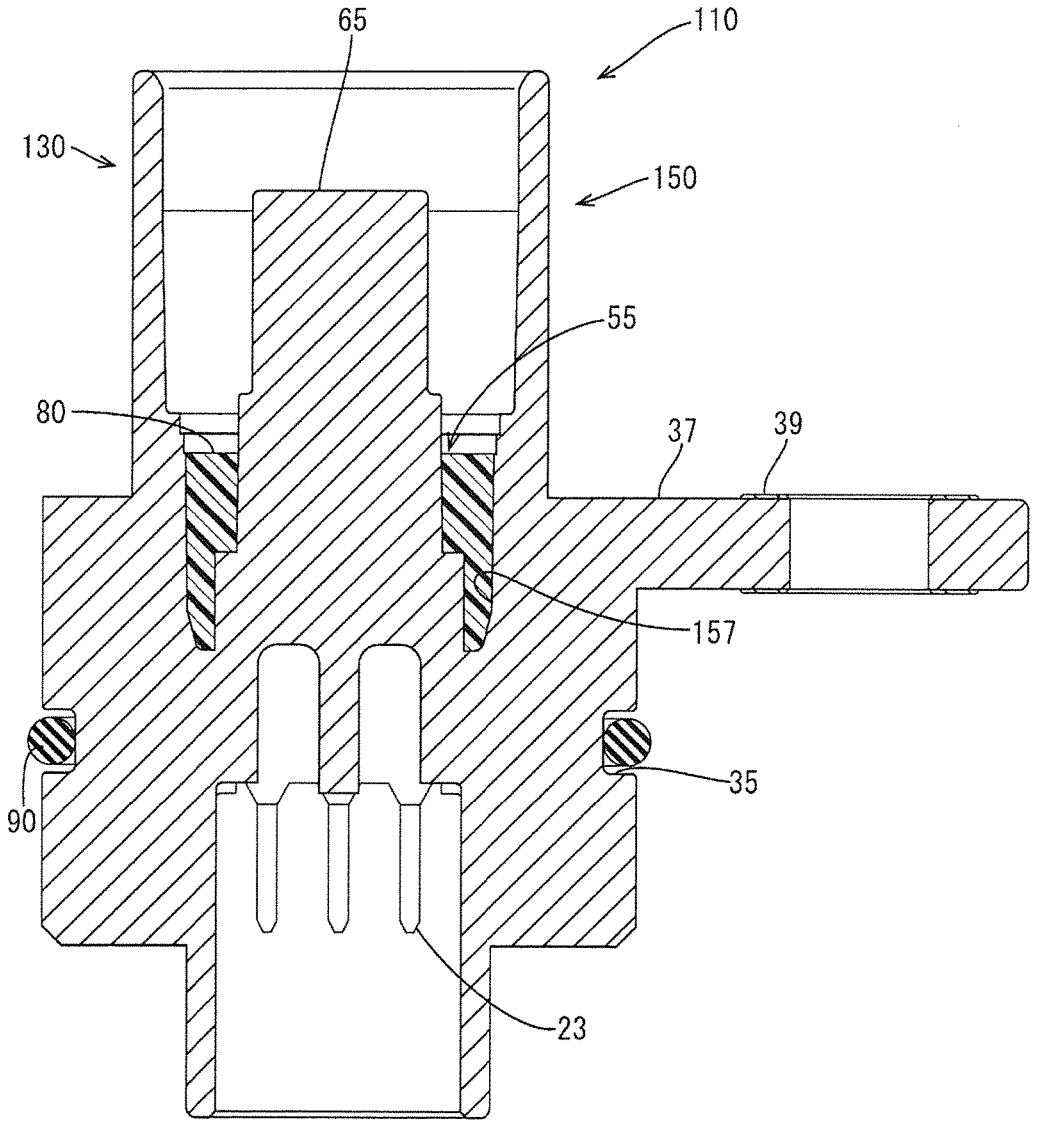
FIG. 10 is a section of a connector at the position of FIG. 5 in a second embodiment.
Figure 11:
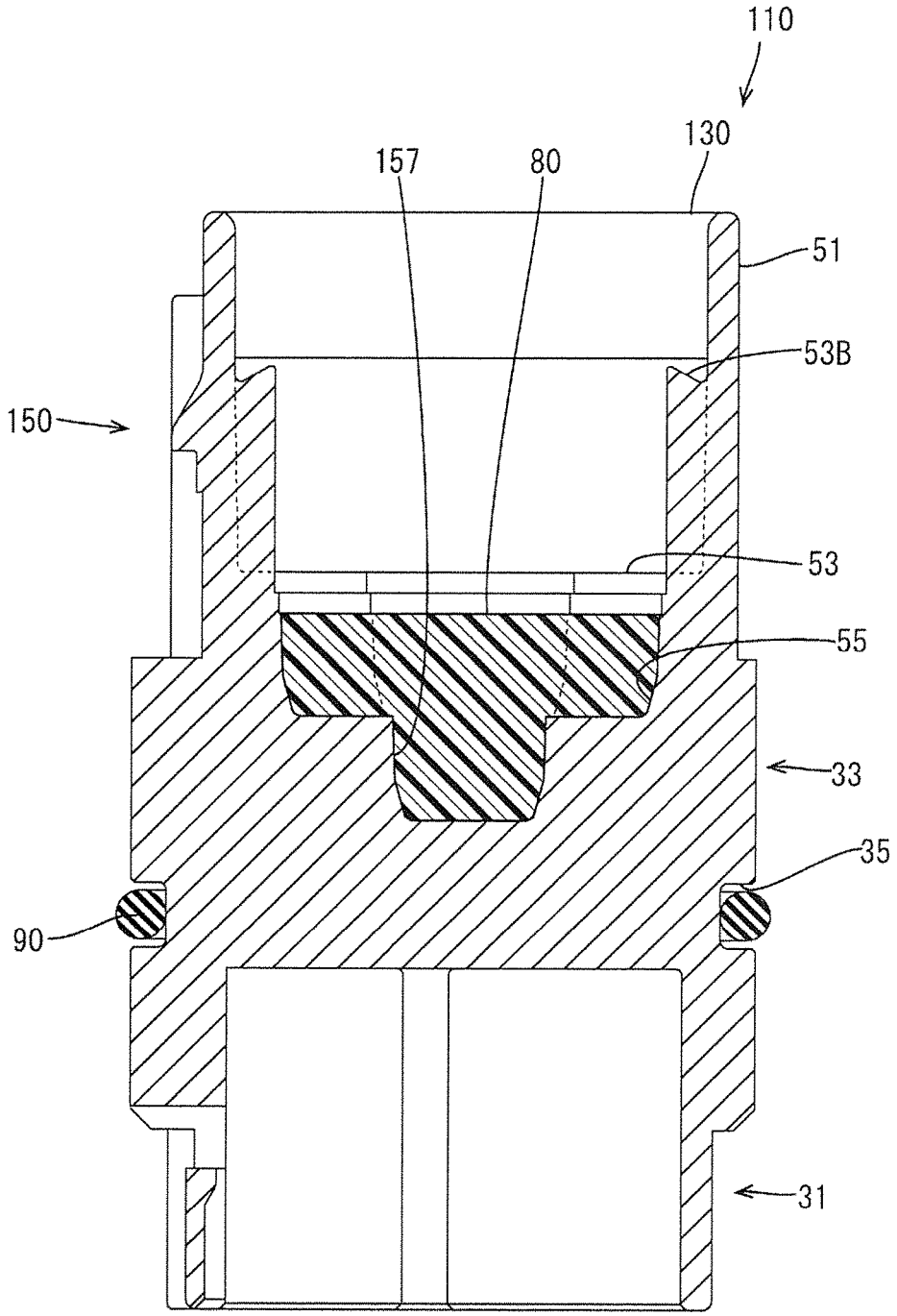
FIG. 11 is a section of the connector at the position of FIG. 6 in the second embodiment.
Figure 12:
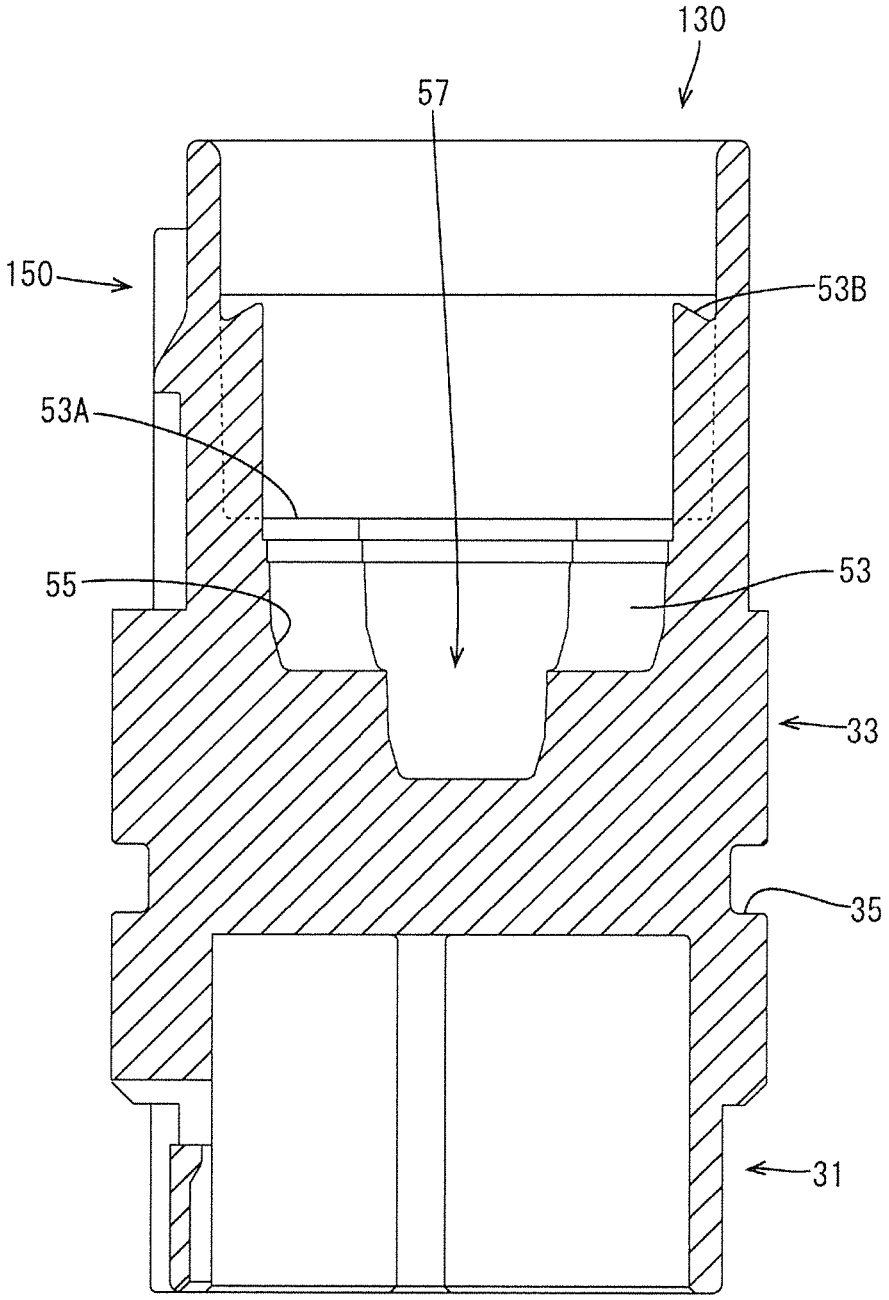
FIG. 12 is a section of the connector at the position of FIG. 9 in the second embodiment.

Next, a second embodiment is described with reference to FIGS. 10 to 12. In a connector 110 of the second embodiment, the shape of auxiliary reservoirs 157 is different from that of the first embodiment. Note that members and parts having the same functions as in the first embodiment are denoted by the same reference signs, and are not described or are described briefly.

An external connecting portion 150 of a connector housing 130 of the connector 110 is provided with the auxiliary reservoirs 157 communicating with a filling recess 55. The auxiliary reservoirs 157 are provided substantially at central positions of the filling recess 55 in a long-side direction and on both sides of the filling recess 55 in a short-side direction. The auxiliary reservoirs 157 are formed by cutting off parts of an inner wall 53 toward a receptacle 51, and the back end surfaces of the auxiliary reservoirs 157 are located at the same positions as the back end surface of the filling recess 55. That is, the auxiliary reservoirs 157 are recessed more toward the back side than the filling recess 55.

Since the auxiliary reservoirs 157 are provided between injection points P for a potting agent 80 and the inner wall 53, the injected potting agent 80 also spreads from the injection points P to the auxiliary reservoirs 157. The auxiliary reservoirs 157 are deeper than the filling recess 55. Thus, the potting agent 80 flows and is filled also in a height direction. Thus, the leak-out of the potting agent 80 can be suppressed even if the areas of the auxiliary reservoirs 157 are made smaller than in the first embodiment.

<Other Embodiment>

The invention is not limited to the above described and illustrated embodiments. For example, the following modes also are included.

Although the partition walls 61 and the hand touch preventing rib 65 are provided in the above first and second embodiments, they may be omitted.

Although the inner wall 53 is provided on the inner peripheral side of the receptacle 51 in the above first and second embodiments, the receptacle itself may be thickened and the auxiliary reservoirs may be formed by recessing the receptacle.

Although two auxiliary reservoir portions 57; 157 are provided in the first and second embodiments, the number of the auxiliary reservoirs may be increased or decreased according to the number of the injection points P. Note that the number of the auxiliary reservoir portions 57; 157 is preferably equal to the number of the injection points, but may be different.

Although the recessed parts of the inner wall 53 are recessed farther toward the back in the second embodiment, the auxiliary reservoirs may be formed by recessing the back wall between the injection points P and the inner wall 53 toward the back.

LIST OF REFERENCE SIGNS

10, 110 . . . connector
20 . . . terminal fitting
20A, 20B . . . terminal fitting group
30, 130 . . . connector housing
33 . . . separation wall
50, 150 . . . external connecting portion
51 . . . receptacle
53 . . . inner wall
53A . . . connection surface
55 . . . filling recess
57, 157 . . . auxiliary reservoir
61 . . . partition wall
65 . . . hand touch preventing rib (external matter preventing rib)
80 . . . potting agent
P . . . injection point

The invention claimed is:

1. A connector, comprising:

a connector housing including a separation wall with a substantially planar separation wall surface;

terminal fittings constituting first and second terminal fitting groups penetrating through the separation wall and projecting from the separation wall surface;

an external matter preventing rib between the first and second terminal fitting groups and projecting from the separation wall surface farther than the terminal fittings, the external matter preventing rib being configured to suppress intrusion of external matter into a space surrounding the terminal fittings, the external matter preventing rib having a first surface facing toward the first terminal fitting group, a second surface facing toward the second terminal fitting group and opposite first and second ends extending between the first and second surfaces;

a receptacle projecting from the separation wall surface and surrounding the first and second terminal fitting groups and the external matter preventing rib, the receptacle forming a first filling recess surrounding the terminal fittings of the first terminal fitting group and accommodating a potting agent inside and a second filling recess surrounding the terminal fittings of the second terminal fitting group and accommodating the potting agent inside; and the receptacle further having first and second recesses opposed to one another and facing toward the first and second ends of the external matter preventing rib, the first and second recess forming first and second auxiliary reservoirs communicating with each of the filling recesses, back ends of the auxiliary reservoirs and back ends of the filling recesses being defined by the substantially planar separation wall surface.

2. The connector of claim 1, further comprising a partition wall in the filling recess and configured to surround the respective terminal fittings, the partition wall having a height to project from a liquid surface of the filled potting agent.

3. The connector of claim 2, wherein the terminal fittings in each of the terminal fitting groups are proximate to each other via the partition wall, and the auxiliary reservoir communicates with each area in the receptacle divided by the external matter preventing rib.

4. The connector of claim 1, wherein the external matter preventing rib projects from the substantially planar separation wall surface of the separation wall in a height direction, the filling recess extends from the substantially planar separation wall surface of the separation wall in the height direction of the external matter preventing rib, the filling recess having a recess width in a width direction orthogonal to the height direction of the external matter preventing rib, and the auxiliary reservoir portion is a recessed groove that extends from the substantially planar separation wall surface of the separation wall in the height direction of the external matter preventing rib and has a groove width narrower than the recess width of the filling recess.

5. A connector, comprising:

a connector housing including a separation wall, a plurality of terminal fittings constituting two terminal fitting groups penetrating through the separation wall, and a receptacle configured to surround the terminal fitting groups projecting from the separation wall;

an external matter preventing rib provided to project further than the terminal fitting between the two terminal fitting groups, the external matter preventing rib being configured to suppress the intrusion of external matter into the receptacle;

a filling recess configured to surround the terminal fittings in the receptacle and fill a potting agent inside; and an auxiliary reservoir portion for the potting agent formed on an inner peripheral surface of the receptacle between the two terminal fitting groups, wherein a back end surface of the auxiliary reservoir portion constituting a surface on the separation wall side being at the same position as a back end surface of the filling recess constituting a surface of the separation wall side, the back end surface of the auxiliary reservoir portion and the back end surface of the filling recess being coplanar, the external matter preventing rib projecting from the separation wall in a height direction, the filling recess extending from the separation wall in the height direction of the external matter preventing rib and having a recess width in a width direction orthogonal to the height direction of the external matter preventing rib, and the auxiliary reservoir portion being formed as a recessed groove that extends from the separation wall in the height direction of the external matter preventing rib and has a groove width narrower than the recess width of the filling recess.

* * * * *